US008148918B2

(12) United States Patent
Ger

(10) Patent No.: US 8,148,918 B2
(45) Date of Patent: Apr. 3, 2012

(54) LIGHT SOURCE DRIVING DEVICE

(75) Inventor: Chih-Chan Ger, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 489 days.

(21) Appl. No.: 12/417,599

(22) Filed: Apr. 2, 2009

(65) Prior Publication Data

US 2009/0261758 A1 Oct. 22, 2009

(30) Foreign Application Priority Data

Apr. 18, 2008 (TW) ..... 97114108 A

(51) Int. Cl.
*H05B 37/02* (2006.01)

(52) U.S. Cl. ..... 315/307; 315/224; 315/291

(58) Field of Classification Search ..... None
See application file for complete search history.

(56) References Cited

U.S. PATENT DOCUMENTS 5,519,289 A * 5/1996 Katyl et al. ..... 315/224
6,115,268 A * 9/2000 Chang et al. ..... 363/34
7,315,464 B2 1/2008 Sawada et al.
7,511,437 B2 * 3/2009 Lys et al. ..... 315/307
2005/0105305 A1 * 5/2005 Sawada et al. ..... 363/34

* cited by examiner

*Primary Examiner* — Shawki S Ismail
*Assistant Examiner* — Crystal L Hammond
(74) *Attorney, Agent, or Firm* — Altis Law Group, Inc.

(57) ABSTRACT

A light source driving device drives a plurality of light sources. A Power Factor Circuit (PFC) circuit converts a received electrical signal to a DC signal and output to a DC/AC converting circuit. The DC/AC converting circuit converts the DC signal to another AC signal, which is isolated by the transformer circuit. A resonance balancing circuit converts the AC signal output from the transformer circuit to another AC signal to drive the light source module. A PWM dimming controller outputs a control signal to control output of the DC/AC converting circuit according to a received dimming signal, wherein duty cycle of the control signal is fixed. A voltage dividing circuit adjustably divides voltage of the DC signal output from the PFC circuit. A PFC controller feeds the divided signal back to the PFC circuit to control the DC signal output from the PFC circuit.

20 Claims, 6 Drawing Sheets

LIGHT SOURCE DRIVING DEVICE

BACKGROUND

1. Field of the Invention

Embodiments of the present disclosure relate to light source driving devices, and particularly to a light source driving device integrated with an alternating current (AC)/direct current (DC) converter.

2. Description of Related Art

Conventionally, discharge lamps, such as Cold Cathode Fluorescent Lamps (CCFLs) and External Electrode Fluorescent Lamps (EEFLs) have been used as light sources for liquid crystal displays (LCDs). In LCD modules, current through the lamps is controlled by adjustment of a duty cycle of Pulse-Width Modulator (PWM) controller.

FIG. 6 shows one such light source driving device to drive a light source module 14. The light source driving device comprises an AC power source 10, an AC/DC converter 11, an inverter circuit 12, a PWM dimming controller 13, a PWM dimming isolator 131, and a PWM dimming driving circuit 132. The AC/DC converter 11 comprises a Power Factor Correction (PFC) circuit 110, a DC/AC converting circuit 111 and an isolating and rectifying circuit 112.

The AC power source 10 provides an electrical signal, which is converted to a DC signal via the PFC circuit 110, and output to the DC/AC converting circuit 111. The DC/AC converting circuit 111 converts the DC signal to a square-wave signal isolated by the isolating and rectifying circuit 112. The isolating and rectifying circuit 112 converts the isolated square-wave signal to another DC signal. The inverter circuit 12 converts the received DC signal to a sine-wave signal, which is output to the light source module 14. The PWM dimming controller 13 outputs a control signal to control output of the DC/AC converting circuit 111 according to a current feedback signal output from the light source module 14 via the PWM dimming isolator 131 and the PWM dimming driving circuit 132.

Current through the light source module 14 is adjusted by adjusting the duty cycle of the control signal output from the PWM dimming controller 13. In this way, components of the DC/AC converting circuit 111 are switched frequently, which accelerates aging and shortens life of the components. In addition, there is need for a current feedback circuit in the light source driving device, which increases cost and unit size.

DETAILED DESCRIPTION OF CERTAIN INVENTIVE EMBODIMENTS

Figure 1:
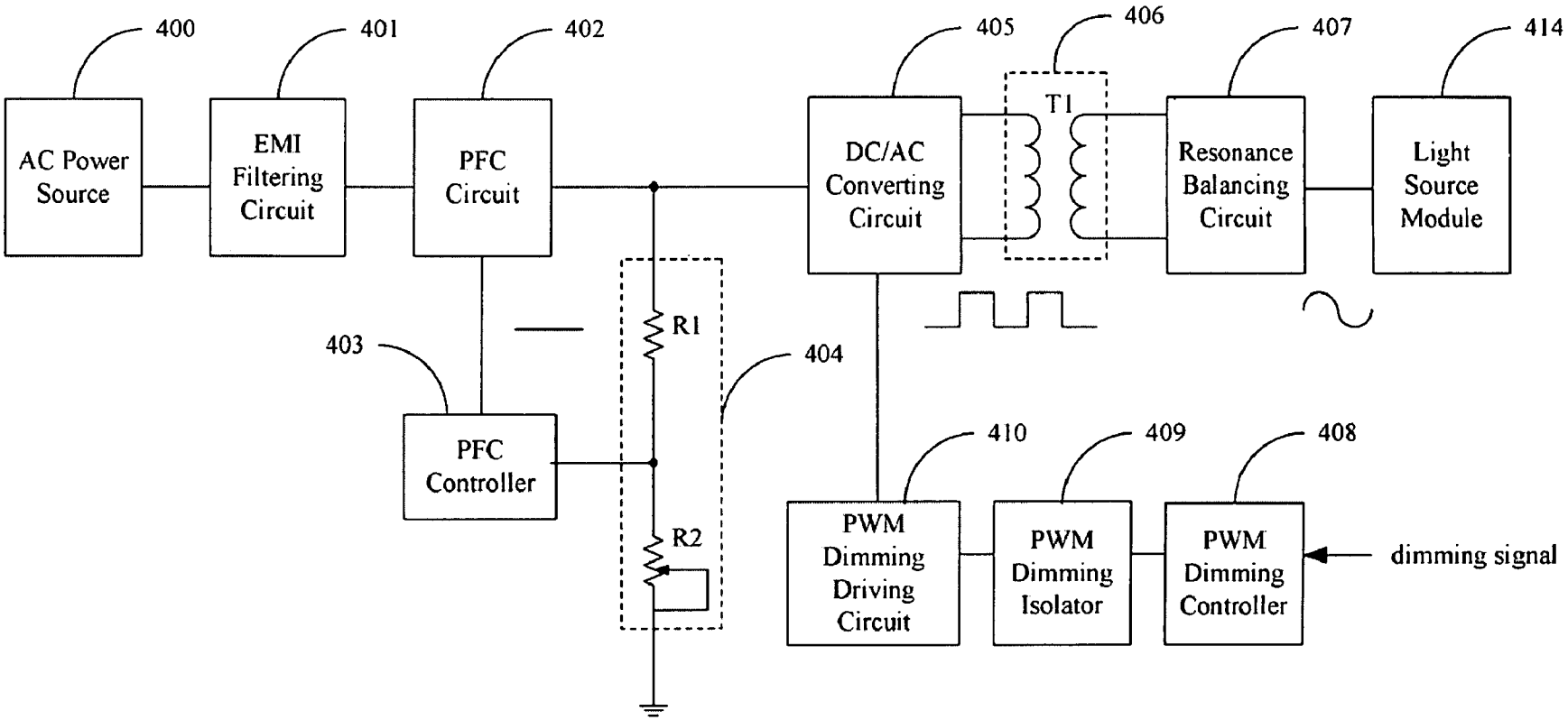
FIG. 1 is a block diagram of a first embodiment of a light source driving device in accordance with the present disclosure.

FIG. 1 is a block diagram of a first embodiment of a light source driving device to drive a light source module 414 in accordance with the present disclosure. The light source driving device comprises an alternating current (AC) power source 400, an electromagnetic interference (EMI) filtering circuit 401, a power factor correction (PFC) circuit 402, a PFC controller 403, a voltage dividing circuit 404, a DC/AC converting circuit 405, a transformer circuit 406, a resonance balancing circuit 407, a PWM dimming controller 408, a PWM dimming isolator 408 and a PWM dimming driving circuit 410. The light source module 414 comprises a plurality of light sources, such as discharge lamps.

The AC power source 400 provides an electrical signal. The electrical signal is filtered via the EMI filtering circuit 401 and output to the PFC circuit 402. The EMI filtering circuit 401 is connected between the AC power source 400 and the PFC circuit 402 to filter EMI in the electrical signal. PFC circuit 402 is a boost circuit, which converts the electrical signal to a direct current (DC) signal and boosts the DC signal. Voltage of the boosted DC signal is approximately 400V, in one example.

PFC controller 403 is connected to an output of the PFC circuit 402. The voltage dividing circuit 404 is connected between the output of the PFC circuit 402 and ground to adjustably divide the voltage of the boosted DC signal, and output the divided signal. A voltage dividing ratio of the voltage dividing circuit 404 can be adjusted. The voltage dividing circuit 404 comprises a first resistor R1 and a second resistor R2. At least one of the first resistor R1 and the second resistor R2 is a variable resistor. The first resistor R1 is connected between the output of the PFC circuit 402 and the PFC controller 403 to divide the voltage of the boosted DC signal. The second resistor R2 is a variable resistor connected between the first resistor R1 and ground to adjust the voltage dividing ratio of the voltage dividing circuit 404. Thus, voltage of the divided signal output to the PFC controller 403 can be adjusted.

The PFC controller 403 feeds the divided signal to the PFC circuit 402 to control the boosted DC signal.

The DC/AC converting circuit 405 is connected to the output of the PFC circuit 402 to convert the boosted DC signal to another AC signal. The other AC signal output from the DC/AC converting circuit 405 is a square-wave signal, and the DC/AC converting circuit 405 can be a full-bridge circuit, a half-bridge circuit, a push-pull circuit, or a royer circuit, depending on the embodiment.

The transformer circuit 406 is connected to the DC/AC convert circuit 405 to isolate the AC signal output from the DC/AC convert circuit 405. Transformer circuit 406 comprises an isolated transformer T1 having a primary winding and a secondary winding. The primary winding of the isolated transformer T1 is connected the DC/AC converting circuit 405, and the secondary winding thereof is connected to the resonance balancing circuit 407. Alternatively, the isolated transformer T1 can have a plurality of secondary windings. According to safety rules, the isolated transformer T1 isolates the AC power source 400 from the light source module 414 and the resonance balancing circuit 407, in order to protect the light source module 414 and the resonance balancing circuit 407.

The resonance balancing circuit 407 converts the AC signal output from the transformer circuit 406 to another AC signal to drive the light source module 414, and balances current through the light source module 414. The AC signal output from the resonance balancing circuit 407 is a sine-wave signal. Normally, leakage of each transformer is different, so that capacitors, inductors, transformers or some combination of capacitors, inductors and transformers may be added to resonate and balance current in an actual circuit.

The PWM dimming controller 408 is connected to the DC/AC converting circuit 405 to output a control signal to control output of the DC/AC converting circuit 405 according to a received dimming signal. Here, a duty cycle of the control signal is fixed, and the control signal is a high frequency PWM signal and the dimming signal is a low frequency PWM signal. Normally, because the PWM dimming controller 408 is a chip, the duty cycle of the control signal is set to a maximum value accepted by the chip, and may be adjusted by resistors or capacitors of corresponding pins of the PWM dimming controller 408. The PWM dimming controller 408 does not receive a current feedback signal output from the light source module 414, so that the duty cycle of the PWM dimming controller 408 is not changed. In another embodiment, the PWM dimming controller 408 is also connected to the DC/AC converting circuit 405 via a PWM dimming isolator 409 and a PWM dimming driving circuit 410. In detail, the PWM dimming isolator 409 is connected to the PWM dimming controller 408, and the PWM dimming driving circuit 410 is connected between the PWM dimming isolator 409 and the DC/AC converting circuit 405. The PWM dimming isolator 409 can be an isolator transformer or a photo-coupler, and isolates the PWM dimming controller 408 from the AC power source 400. The PWM dimming driving circuit 410 steps the control signal output from the PWM dimming controller 408 to drive the DC/AC converting circuit 405.

The light source driving device of FIG. 1 omits the need for a feedback circuit, and accordingly provides a simplified structure at a lower cost.

Figure 2:
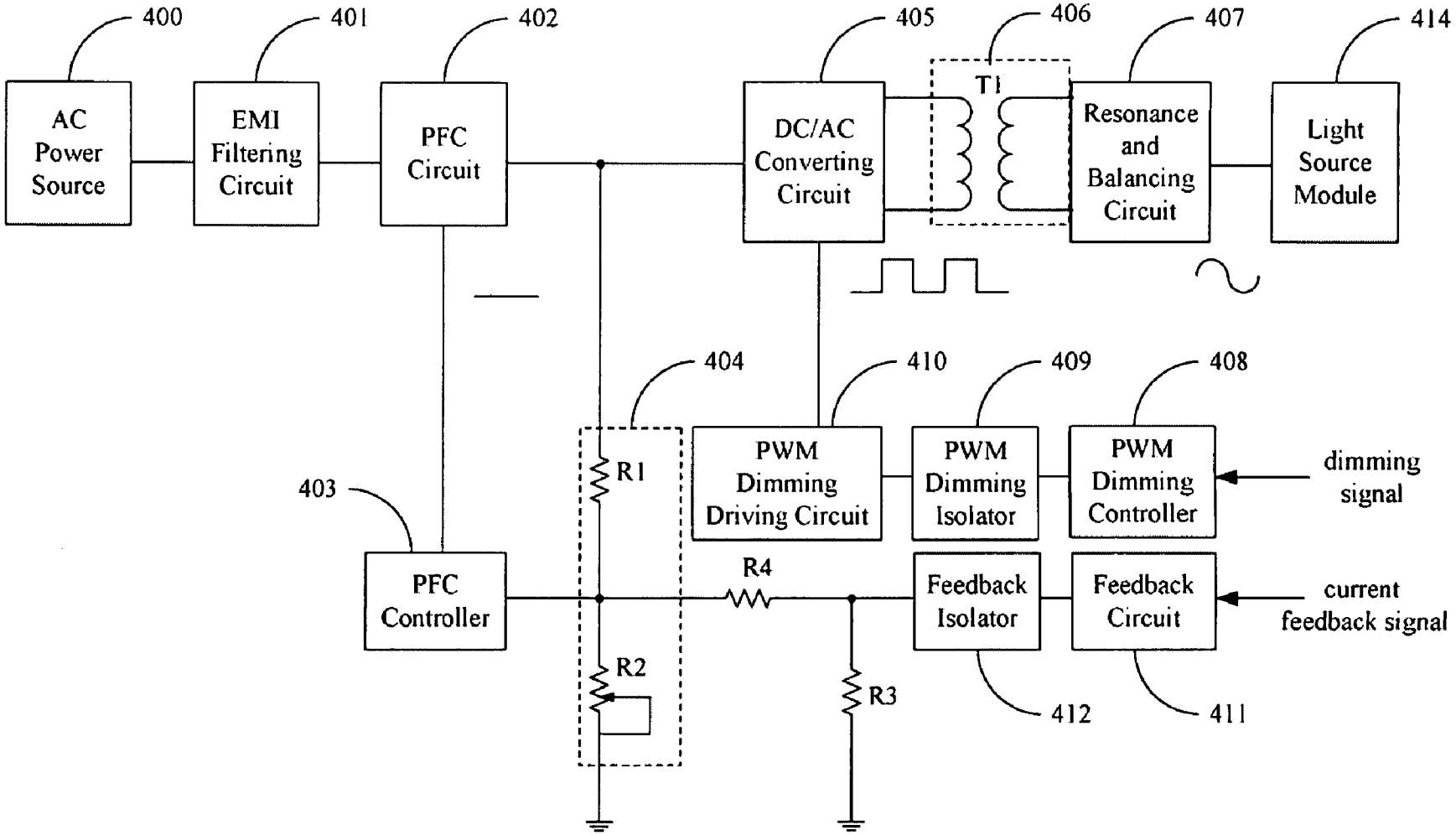
FIG. 2 is a block diagram of a second embodiment of a light source driving device in accordance with the present disclosure.

FIG. 2 is a block diagram of a second embodiment of a light source driving device in accordance with the present disclosure, differing only from that of FIG. 1 in the inclusion of a feedback circuit 411, a feedback isolator 412, a third resistor R3 and a fourth resistor R4.

The feedback circuit 411 is connected to the voltage dividing circuit 404 via the feedback isolator 412 and the fourth resistor R4. The feedback circuit 411 receives a current feedback signal and provides it to the PFC controller 403. Here, the current feedback signal is detected by external equipment before use. The voltage dividing ratio of the voltage dividing circuit 404 is adjusted by the current feedback signal, with voltage of the divided signal input to the PFC controller 403 adjusted accordingly. Thus, the output of the PFC circuit 402 can be adjusted.

Here, the feedback isolator 412 isolates the feedback circuit 411 from the AC power source 400. The feedback isolator 412 can be an isolating transformer or a photo-coupler. The third resistor R3 is connected between the feedback isolator 412 and ground to convert the current feedback signal to a voltage feedback signal. The fourth resistor R4 is connected to a common junction between the third resistor R3 and the feedback isolator 412 and the voltage dividing circuit 404 to adjust the voltage feedback signal output from the third resistor R3.

Here, the light source driving device of FIG. 2 is a closed loop. Differences between the detected current signal and an actual current signal include, in order to offset the differences used, the feedback circuit 411 receives the current feedback signal, and provides it to the PFC controller 403 to adjust the output of the PFC circuit 402. Thus, the current through the light source module 414 can be adjusted.

Figure 3:
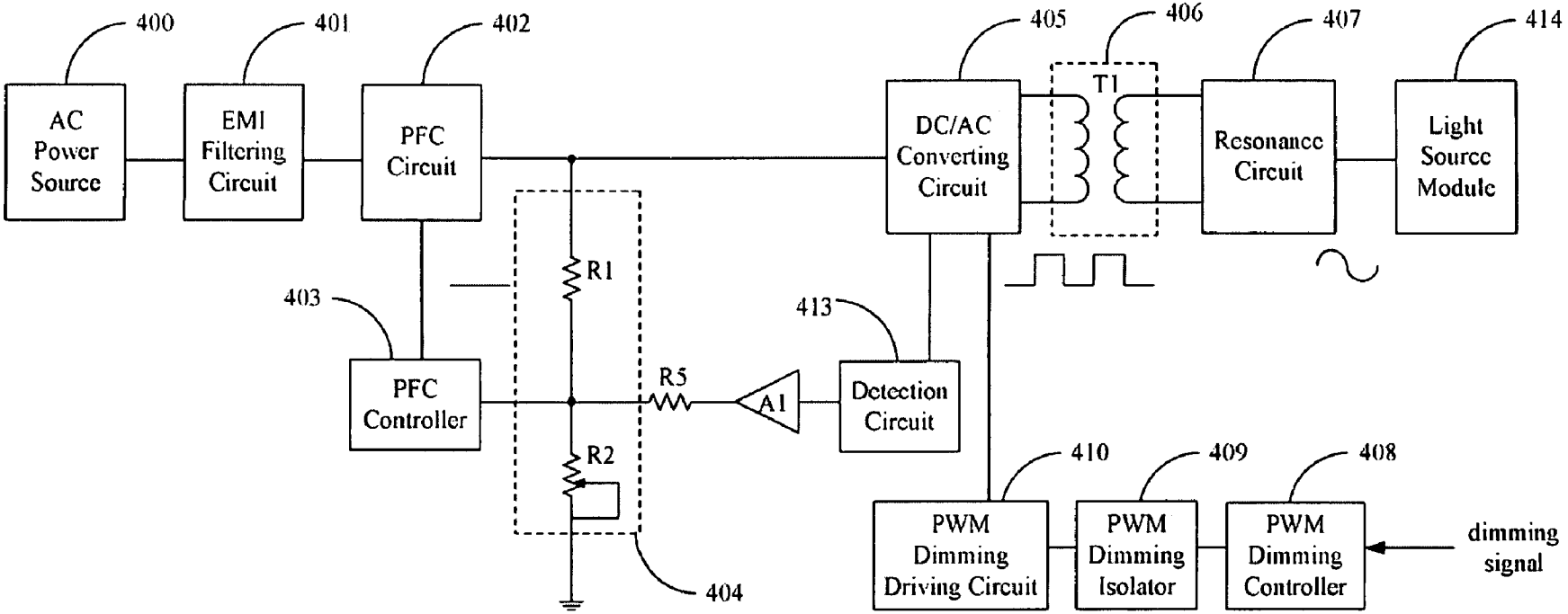
FIG. 3 is a block diagram of a third embodiment of a light source driving device in accordance with the present disclosure.

FIG. 3 is a block diagram of a third embodiment of a light source driving device in accordance with the present disclosure, differing from that of FIG. 1 only in the inclusion of a detection circuit 413, an amplifier A1, and a fifth resistor R5.

The detection circuit 413 is connected to the DC/AC converting circuit 405 to detect current through the DC/AC converting circuit 405 and convert the detected current signal to a voltage signal. The amplifier A1 has an input and an output. The input of the amplifier A1 is connected to the detection circuit 413, and the output thereof is connected to one end of the fifth resistor R5 to amplify the voltage signal output from the detection circuit 413. The other end of the fifth resistor R5 is connected to a common junction of the PFC controller 403 and the first resistor R1 to adjust the amplified voltage signal. In other words, the fifth resistor R5 is connected between the output of the detection circuit 413 and the PFC controller 403 to adjust the amplified voltage signal. Similarly, impedance of the second resistor R2 is adjusted according to the voltage signal in order to adjust the output of the PFC circuit 402. Thus, the current through the light source module 414 can be adjusted. In other embodiments, the amplifier A1 can be omitted.

Here, the light source driving device of FIG. 3 is a closed loop. There are some differences between the tested current signal and an actual current signal. In order to offset the differences being used, the detection circuit 413 detects the current through the DC/AC converting circuit 405 and provides to the PFC controller 403 to adjust the output of the PFC circuit 402. Thus, the current through the light source module 414 can be adjusted.

Figure 4:
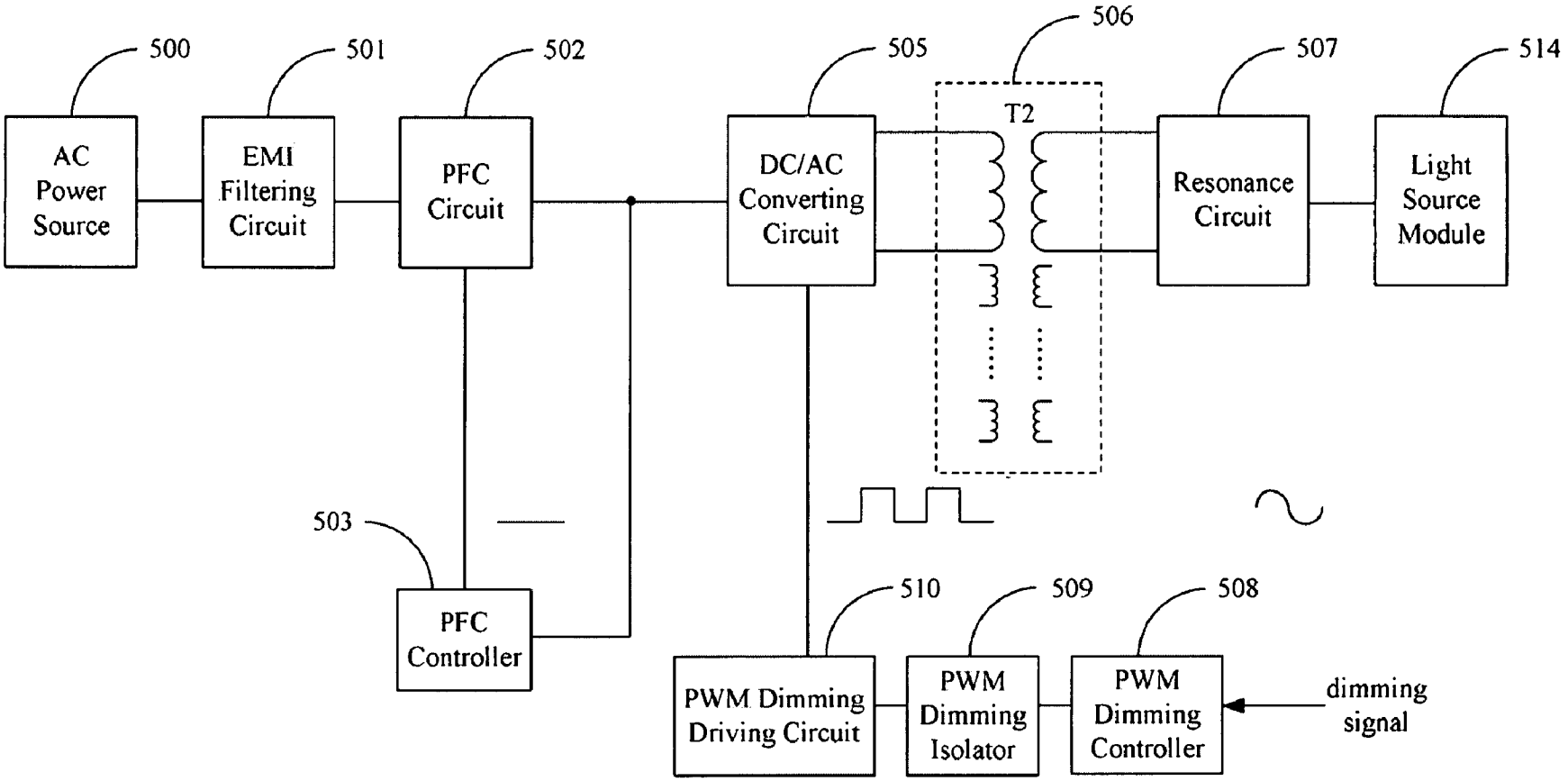
FIG. 4 is a block diagram of a fourth embodiment of a light source driving device in accordance with the present disclosure.

FIG. 4 is a block diagram of a fourth embodiment of a light source driving device for driving a light source module 514 in accordance with the present disclosure, differing from that of FIG. 1 only in the inclusion of an AC power source 500, an EMI filtering circuit 501, a PFC circuit 502, a PFC controller 503, a DC/AC converting circuit 505, a variable transformer circuit 506, a resonance balancing circuit 507, a PWM dimming controller 508, a PWM dimming isolator 509, and a PWM dimming driving circuit 510. Here, the light source module 514 comprises a plurality of light sources, such as discharge lamps.

The AC power source 500 provides an electrical signal. The electrical signal is filtered via the EMI filtering circuit 501 and output to the PFC circuit 502. The EMI filtering circuit 501 is connected between the AC power source 500 and the PFC circuit 502 to filter EMI signals in the electrical signal. Here, the PFC circuit 502 is a boost circuit, which converts the electrical signal to a direct current (DC) signal and boosts the DC signal. Voltage of the boosted DC signal is approximately 400V.

Here, the PFC controller 503 is connected to an output of the PFC circuit 502 to feed the DC signal output from the PFC circuit 502 to control the DC signal.

The DC/AC converting circuit 505 is connected to the output of the PFC circuit 502 to convert the boosted DC signal to another AC signal. The other AC signal output from the DC/AC converting circuit 505 is a square-wave signal, and the DC/AC converting circuit 505 can be a full-bridge circuit, a half-bridge circuit, a push-pull circuit, or a royer circuit.

The variable transformer circuit 506 is connected to the DC/AC converting circuit 505 to isolate the AC signal output from the DC/AC converting circuit 505. Here, the isolated AC signal output of the variable transformer circuit 506 is adjusted, and the variable transformer circuit 506 comprises a variable isolation transformer T2 having at least one primary winding and at least one secondary winding. The primary winding of the variable isolation transformer T2 is connected to DC/AC converting circuit 505, and the secondary winding thereof is connected to the resonance balancing circuit 507. Connections of the primary winding or the secondary winding of the variable isolation transformer T2 can be adjusted to adjust parameters, such as current and so on, of the driving device in a predetermined range. According to safety rules, to protect the light source module 514 and the resonance balancing circuit 507, the variable isolation transformer T2 isolates the AC power source 500 from the light source module 514 and the resonance balancing circuit 507.

Normally, the isolated AC signal output from the variable isolation transformer T2 can be changed by changing the turn ratio of the primary windings and the secondary windings. Thus, the current through the light source module 514 can be adjusted. The primary winding or secondary winding of the variable isolation transformer T2 is selectively connected by a connector or soldering.

The resonance balancing circuit 507 converts the AC signal output from the transformer circuit 506 to another AC signal to drive the light source module 514, and balances current through the light source module 514. Here, the AC signal output from the resonance balancing circuit 507 is a sine-wave signal. In product process, because leakage of each transformer is different, to resonate and balance the current through the light source module, not only capacitors, but also inductors or transformers or combinations thereof are added to resonate and balance the currents in an actual circuit.

The PWM dimming controller 508 is connected to the DC/AC converting circuit 505 to output a control signal to control output of the DC/AC converting circuit 505 according to a received dimming signal. Here, duty cycle of the control signal is fixed, and the control signal is a high frequency PWM signal and the dimming signal is a low frequency PWM signal. Normally, because the PWM dimming controller 508 is a chip, the duty cycle of the control signal is set to a maximum value accepted by the chip, adjusted by resistors or capacitors of corresponding pins of the PWM dimming controller 508. Here, the PWM dimming controller 508 does not receive a current feedback signal output from the light source module 514, so that the duty cycle of the PWM dimming controller 508 is not changed. In another embodiment, the PWM dimming controller 508 is connected to the DC/AC converting circuit 405 via a PWM dimming isolator 509 and a PWM dimming driving circuit 510. In detail, the PWM dimming isolator 509 is connected to the PWM dimming controller 508, and the PWM dimming driving circuit 510 is connected between the PWM dimming isolator 509 and the DC/AC converting circuit 505. Here, the PWM dimming isolator 509 can be an isolator transformer or a photo-coupler to isolate the PWM dimming controller 508 from the AC power source 500. The PWM dimming driving circuit 510 steps the control signal output from the PWM dimming controller 508 to drive the DC/AC converting circuit 505.

Here, the light source driving device of FIG. 4 is a open loop with no requirement for a feedback circuit, thus providing simplified structure and lower cost.

Figure 5:
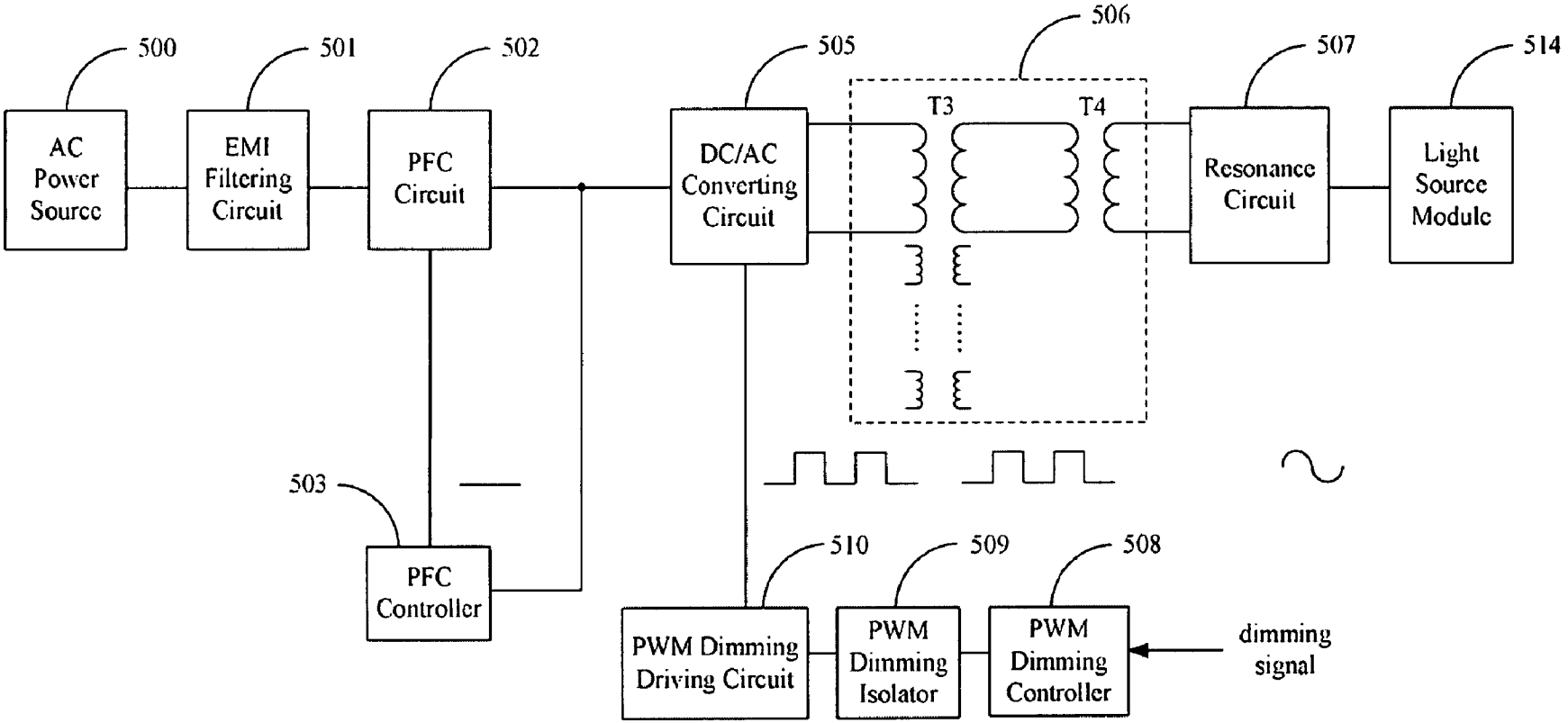
FIG. 5 is a block diagram of a fifth embodiment of a light source driving device in accordance with the present disclosure.
Figure 6:
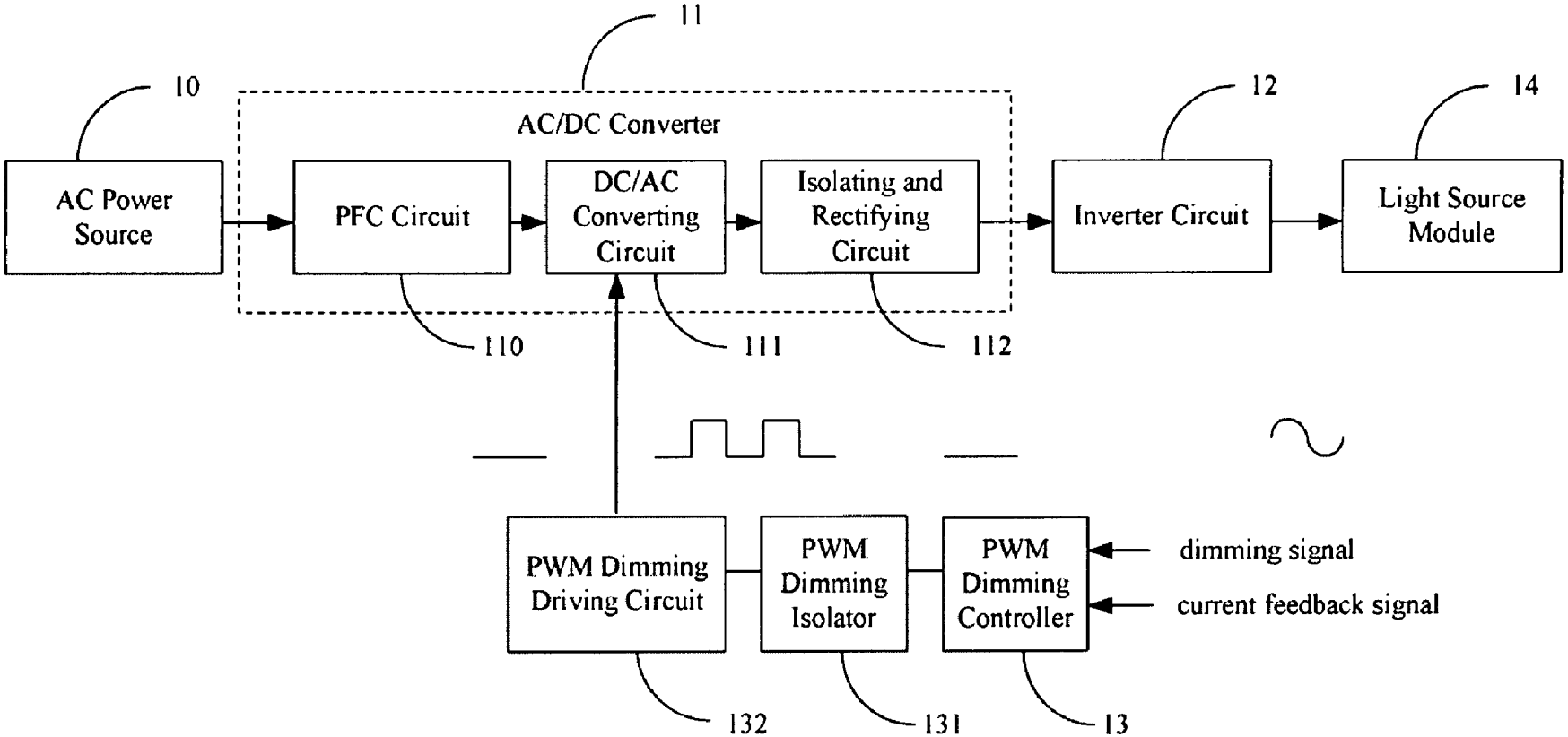
FIG. 6 (Related Art)
FIG. 6 is a block diagram of a light source driving device.

FIG. 5 is a block diagram of a fifth embodiment of a light source driving device in accordance with the present disclosure, differing from that of FIG. 4 only in that the variable transformer 506 of the light source driving device of FIG. 5 comprises a variable isolation transformer T3 and transformer T4.

The variable isolation transformer T3 comprises at least one primary winding and at least one secondary winding. The primary winding of the variable isolation transformer T3 is connected to the DC/AC converting circuit 505 to isolate the AC signal output from the DC/AC converting circuit 505. Connections of the primary winding or secondary winding of the variable isolation transformer T3 are adjusted to adjust the parameters, such as current and so on, of the driving device in a predetermined range. According to safety rules, in order to protect the light source module 514 and the resonance balancing circuit 507, the variable isolation transformer T2 isolates the AC power source 500 from the light source module 514 and the resonance balancing circuit 507. Normally, the isolated AC signal output from the variable isolation transformer T3 can be changed by changing the turn ratio of the primary winding and the secondary winding. Thus, the current through the light source module 514 can be adjusted. The primary winding or secondary winding of the variable isolation transformer T2 is selectively connected by a connector or soldering.

The transformer T4 has a primary winding and a secondary winding. The primary winding of the transformer T4 is connected to the secondary winding of the variable isolation transformer T3, and the secondary winding of the transformer T4 is connected to the resonance balancing circuit 507 to step the isolated AC signal output from the variable isolation transformer T3.

In the disclosure, the duty cycle of the control signal output from the PWM dimming controller is a fixed value, which decrease aging rate of the DC/AC converting circuit. In addition, the voltage dividing circuit 404 or the variable transformer circuit 506 adjusts the current affected by the differences between the tested current signal and an actual current signal, which can steady the current through the light source module and prolong life of the light sources.

While various embodiments and methods of the present disclosure have been described, it should be understood that they have been presented by way of example only and not by way of limitation. Thus the breadth and scope of the present disclosure should not be limited by the above-described embodiments, but should be defined only in accordance with the following claims and their equivalents.

What is claimed is:

1. A light source driving device, for driving a plurality of light sources, comprising:

a Power Factor Correction (PFC) circuit that converts a received electrical signal to a direct current (DC) signal;

a DC/AC converting circuit connected to an output of the PFC circuit for converting the DC signal to an AC signal;

a transformer circuit connected to the DC/AC converting circuit for isolating the AC signal output from the DC/AC converting circuit;

a resonance balancing circuit connected to the transformer circuit for converting the isolated AC signal to another AC signal capable of driving the plurality of light sources;

a PWM dimming controller connected to the DC/AC converting circuit for outputting a control signal to control output of the DC/AC converting circuit according to a received dimming signal, wherein duty cycle of the control signal is fixed;

a voltage dividing circuit connected between the output of the PFC circuit and ground for adjustably dividing voltage of the DC signal output from the PFC circuit, and outputting a divided voltage signal; and a PFC controller for feeding the divided voltage signal back to the PFC circuit to control the DC signal output from the PFC circuit.

2. The light source driving device as claimed in claim 1, further comprising an AC power source to provide the electrical signal.

3. The light source driving device as claimed in claim 2, further comprising an Electro Magnetic Interference (EMI) filtering circuit connected between the AC power source and the PFC circuit to filter EMI signals in the electrical signal.

4. The light source driving device as claimed in claim 1, wherein the voltage dividing circuit comprises:

a first resistor connected between the output of the PFC circuit and the PFC controller to divide the voltage of the DC signal output from the PFC circuit; and a second resistor connected between the first resistor and the ground to adjust a voltage dividing ratio;

wherein at least one of the first resistor or the second resistor is a variable resistor.

5. The light source driving device as claimed in claim 1, wherein the transformer circuit comprises an isolation transformer comprising a primary winding and at least one secondary winding, and wherein the primary winding of the isolation transformer is connected to the DC/AC converting circuit and the secondary winding of the isolation transformer is connected to the resonance balancing circuit.

6. The light source driving device as claimed in claim 1, further comprising:

a feedback circuit that receives a current feedback signal and provides the signal to the PFC controller; and a feedback isolator connected between the feedback circuit and the PFC controller for isolating the feedback circuit from the AC power source.

7. The light source driving device as claimed in claim 6, further comprising:

a third resistor connected between the feedback isolator and ground to convert the current feedback signal to a voltage feedback signal; and a fourth resistor connected between a common junction of the third resistor and the feedback isolator and the voltage dividing circuit to adjust the voltage feedback signal output from the third resistor.

8. The light source driving device as claimed in claim 1, further comprising:

a detection circuit connected to the DC/AC converting circuit to detect current through the DC/AC converting circuit and convert the detected current signal to a voltage signal;

a fifth resistor connected between the output of the detection circuit and the PFC controller to adjust the amplified voltage signal.

9. The light source driving device as claimed in claim 1, further comprising:

a PWM dimming isolator connected to the PWM and dimming controller to isolate the AC power source and the PWM and dimming controller;

a PWM dimming driving circuit connected between the DC/AC converting circuit and the PWM dimming isolator for stepping the control signal output from the PWM dimming controller to drive the DC/AC converting circuit.

10. The light source driving device as claimed in claim 1, wherein the control signal output from the PWM and dimming controller is a high frequency signal, and the dimming signal is a low frequency signal.

11. A light source driving device, for driving a plurality of light sources, comprising:

a Power Factor Correction (PFC) circuit that converts a received electrical signal to a direct current (DC) signal;

a DC/AC converting circuit connected to an output of the PFC circuit for converting the DC signal to an AC signal;

a variable transformer circuit connected to the DC/AC converting circuit for isolating the AC signal output from the DC/AC converting circuit, wherein the isolated AC signal output of the variable transformer circuit can be adjusted;

a resonance balancing circuit connected to the variable transformer circuit for converting the isolated AC signal to another AC signal capable of driving the light source module; and a PWM dimming controller connected to the DC/AC converting circuit for outputting a control signal to control output of the DC/AC converting circuit according to a received dimming signal, wherein duty cycle of the control signal is fixed.

12. The light source driving device as claimed in claim 11, further comprising an AC power source to provide the electrical signal.

13. The light source driving device as claimed in claim 12, further comprising an Electro Magnetic Interference (EMI) filtering circuit connected between the AC power source and the PFC circuit for filtering EMI signals in the electrical signal.

14. The light source driving device as claimed in claim 11, further comprising a PFC controller for feeding the output of the PFC circuit to the PFC circuit to control the DC signal output from the PFC circuit.

15. The light source driving device as claimed in claim 11, wherein the transformer circuit comprises a variable isolation transformer comprising at least one primary winding and at least one secondary winding, wherein connections of the primary winding or the secondary winding of the variable isolation transformer to adjust parameters of the driving device to a predetermined range.

16. The light source driving device as claimed in claim 15, wherein the primary winding or the secondary winding of the variable isolation transformer are selectively connected by a connector or soldering.

17. The light source driving device as claimed in claim 11, wherein the variable isolation transformer comprises:

a variable isolation transformer comprising at least one primary winding and at least one secondary winding, wherein connections of the primary winding or the secondary winding of the variable isolation transformer are adjusted to adjust parameters of the driving device to a predetermined range; and a transformer comprising a primary winding and a secondary winding, wherein the primary winding of the transformer is connected to the secondary winding of the isolation transformer, and the secondary winding of the transformer is connected to the resonance balancing circuit for boosting the isolated AC signal output from the variable isolation transformer.

18. The light source driving device as claimed in claim 17, wherein the plurality of the primary windings or the secondary windings of the variable isolation transformer are connected by a connector or soldering.

19. The light source driving device as claimed in claim 11, further comprising:

a PWM dimming isolator connected to the PWM dimming controller for isolating the AC power source and the PWM dimming controller;

a PWM dimming driving circuit connected between the DC/AC converting circuit and the PWM dimming isolator for stepping the control signal output from the PWM dimming controller to drive the DC/AC converting circuit.

20. The light source driving device as claimed in claim 11, wherein the control signal output from the PWM and dimming controller is a high frequency signal, and the dimming signal is a low frequency signal.

* * * * *